US010800003B2

(12) United States Patent
Moller et al.

(10) Patent No.: US 10,800,003 B2
(45) Date of Patent: Oct. 13, 2020

(54) DUST SHROUD

(71) Applicant: Dust Away LLC, Miami Beach, FL (US)

(72) Inventors: Erik Moller, Miami Beach, FL (US); Michael Grisez, Vermillion, OH (US)

(73) Assignee: Dust Away LLC, Miami Beach, FL (US)

( * ) Notice: Subject to any disclaimer, the term of this patent is extended or adjusted under 35 U.S.C. 154(b) by 359 days.

(21) Appl. No.: 15/966,901

(22) Filed: Apr. 30, 2018

(65) Prior Publication Data

US 2018/0326555 A1 Nov. 15, 2018

Related U.S. Application Data

(60) Provisional application No. 62/503,411, filed on May 9, 2017.

(51) Int. Cl.
*B24B 55/10* (2006.01)
*B24B 55/04* (2006.01)
(Continued)

(52) U.S. Cl.
CPC ..... *B24B 55/102* (2013.01); *B24B 23/028* (2013.01); *B24B 55/04* (2013.01);
(Continued)

(58) Field of Classification Search
CPC ..... B24B 55/04; B24B 55/052; B24B 55/06; B24B 55/10; B24B 55/102; B24B 23/028
(Continued)

(56) References Cited

U.S. PATENT DOCUMENTS 5,411,433 A * 5/1995 Keller ..... B24B 55/102 451/451
5,545,082 A 8/1996 Courson et al.
(Continued)

OTHER PUBLICATIONS

"Shop Vac 906-85 2-1/2" to 1-1/4" Conversion Unit" (Amazon) Sep. 18, 2015, 2 pgs.
(Continued)

*Primary Examiner* — Eileen P Morgan
(74) *Attorney, Agent, or Firm* — Rankin Hill & Clark LLP

(57) ABSTRACT

A dust shroud having a shroud body with a vacuum port and a tool connection, the shroud body including a top wall and at least one side wall extending downwardly from about a perimeter of the top wall that defines a dust receiving opening, the shroud body having a top wall opening and the tool connection including a flexible fitting with a flexible fitting base joined to the top wall and extending within the top wall opening, the flexible fitting including a plurality of flexible fingers with a base finger portion and an outer finger portion that extends away from top wall and is selectively with a mounting point of the hand held tool and the flexible fingers allowing selective controlled relative movement between the dust shroud and the hand held tool, the fingers having a finger spacing between adjacent flexible fingers and the outwardly extending flexible fingers having a finger length between the top wall and the distal finger end that is greater than 0.75 inches allowing for selective adjustment and relative movement between the dust shroud and the associated hand held grinder.

20 Claims, 7 Drawing Sheets

(51) Int. Cl.
*B24B 23/02* (2006.01)
*B24B 55/05* (2006.01)
*B24B 55/06* (2006.01)

(52) U.S. Cl.
CPC ..... *B24B 55/052* (2013.01); *B24B 55/06* (2013.01); *B24B 55/10* (2013.01)

(58) Field of Classification Search
USPC ..... 451/451, 453, 456
See application file for complete search history.

(56) References Cited

U.S. PATENT DOCUMENTS 7,524,239 B2 * 4/2009 Schmidberger-Brinek ..... B24B 23/028 451/359
7,625,265 B2 * 12/2009 Woods ..... B24B 55/102 451/359
8,029,341 B2 * 10/2011 Belly ..... B24B 13/01 451/259
8,133,094 B2 * 3/2012 Loveless ..... B24B 55/10 451/28
8,137,165 B2 3/2012 Loveless et al.
8,282,447 B1 * 10/2012 Buser ..... B24B 55/102 451/451
8,381,711 B2 2/2013 Loveless
8,523,637 B2 9/2013 Loveless et al.
8,702,478 B2 * 4/2014 Loveless ..... B24B 23/028 24/681
10,035,240 B2 * 7/2018 Buser ..... B24B 55/102
10,201,889 B2 * 2/2019 Morris ..... B24B 55/052
2002/0115395 A1 8/2002 Zayat
2007/0178815 A1 * 8/2007 Buser ..... B24B 55/102 451/451
2008/0171501 A1 * 7/2008 Woods ..... B24B 55/102 451/451
2009/0156105 A1 * 6/2009 Widmer ..... B24B 55/052 451/359
2009/0181605 A1 * 7/2009 Loveless ..... B24B 55/102 451/456
2009/0181606 A1 7/2009 Loveless et al.
2009/0186559 A1 * 7/2009 Loveless ..... B24B 55/10 451/28
2012/0184193 A1 7/2012 Numata
2016/0184963 A1 * 6/2016 Melancon ..... B24B 55/102 55/307

OTHER PUBLICATIONS

International Search Report for corresponding PCT/US18/30215 dated Jul. 26, 2018, 11 pgs.

* cited by examiner

DUST SHROUD

This application claims priority to provisional patent application Ser. No. 62/503,411 filed on May 9, 2017, which is incorporated by reference herein.

The invention of this application relates to a dust shroud and has been found to work particularly well with hand held grinders and, more particularly, to a dust shroud that can be used for grinders and the like. However, the invention has broader application wherein even though it has been found to work particularly well with grinders, and will be described in connection with these grinders, it has broader uses and should not be limited based on this description.

INCORPORATION BY REFERENCE

The invention of this application relates to dust shroud. Patent Publication No. US2009/0181606 to Loveless et al. discloses a shroud for use with drilling tools and is incorporated by reference for showing the same and forms part of the specification of this application.

BACKGROUND OF THE INVENTION

The invention of this application relates to dust shrouds, which have been known and used for many years in a wide range of fields to reduce dust emissions. However, it has been found that these dust shrouds do not perform well with many grinders wherein there is a need in the industry for an improved dust shroud.

SUMMARY OF THE INVENTION

The invention of this application relates to dust shrouds and has been found to work particularly well with hand held grinders and, more particularly, to a dust shroud that can be used for grinders and the like.

More particularly, the dust shroud of this application includes a shroud body having a vacuum port or connection along with a tool connection wherein the vacuum port is selectively connectable to a vacuum hose and the tool connection is selectively connectable to a hand held tool, such as a hand held grinder.

A dust shroud according to one aspect of the invention of this application includes a tool connection that allows the dust shroud to be used with a wide range of grinders.

According to certain aspects of the present invention, the tool connection includes an adaptive overmolded rubber flexible fitting to allow for the use on a wide range of grinders.

According to certain other aspects of the present invention, the adaptive overmolded rubber flexible fitting also allows for flexibility while in use and allows the user to control height of the shroud to accommodate different types of grinding and/or different shapes in a work piece.

According to yet other aspects of the present invention, the tool connection further includes a clamp arrangement to allow the overmolded flexible fitting to be quickly fixed relative to the wide range of grinders and without changing out clamps designed for each grinder type.

According to further aspects of the present invention, the clamp arrangement can include a hose clamp or worm clamp to provide an inward clamping force to quickly secure the flexible fitting relative to the grinder.

According to certain other aspects of the present invention, the vacuum port or connection can include a first port section and a second port section wherein the first port section is shaped to receive a first size vacuum hose and the second port section is shaped to receive a second size vacuum hose so that the dust shroud can also be used in connection with a wide range of vacuum hoses.

According to yet other aspects of the present invention, the shroud body can include one or more removable wall sections.

According to certain aspects of the present invention, the one or more removable wall sections can be a removable side wall section.

According to certain other aspects of the present invention, the shroud body can include a front side and a rear side and the one or more removable wall sections can be a removable side wall section on the front side.

According to yet other aspects of the present invention, the shroud body can be a generally round body having a top wall with a dust receiving opening opposite of the top wall. Yet further, the tool connection can be positioned in the top wall. According to one set of aspects, the tool connection can be generally centered in the top wall.

According to even yet other aspects of the present invention, the shroud body can be dish shaped wherein the top wall is generally round and the shroud body further includes one or more downwardly extending side walls wherein the bottom edge of the one or more side walls can form the dust receiving opening opposite the top wall.

According to yet further aspects of the present invention, the shroud body can include one or more air vent or intake holes positioned in the shroud body to produce a desired airflow within an inner space of the dust shroud.

According to yet other aspects of the present invention, the shroud body includes a first side and a second side wherein the first and second sides generally extend between the front side and a rear side. Further, the shroud body can be configured such that the vacuum port or connection extends from the first side and the air vent holes are generally in the second side to produce an airflow within the inner space that flows past the tool connection portion of the shroud.

According to further aspects of the present invention, the shroud body can further include one or more flexible extensions that extend downwardly or away from the bottom edge of the one or more side walls to help seal the bottom edge relative to the work piece thereby improving the desired airflow within the inner space.

According to yet further aspects of the present invention, the one or more flexible extensions can include one or more brush extensions.

According to even yet further aspects of the present invention, the one or more removable wall sections can include a flexible extensions and the flexible extension can include one or more brush extensions.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
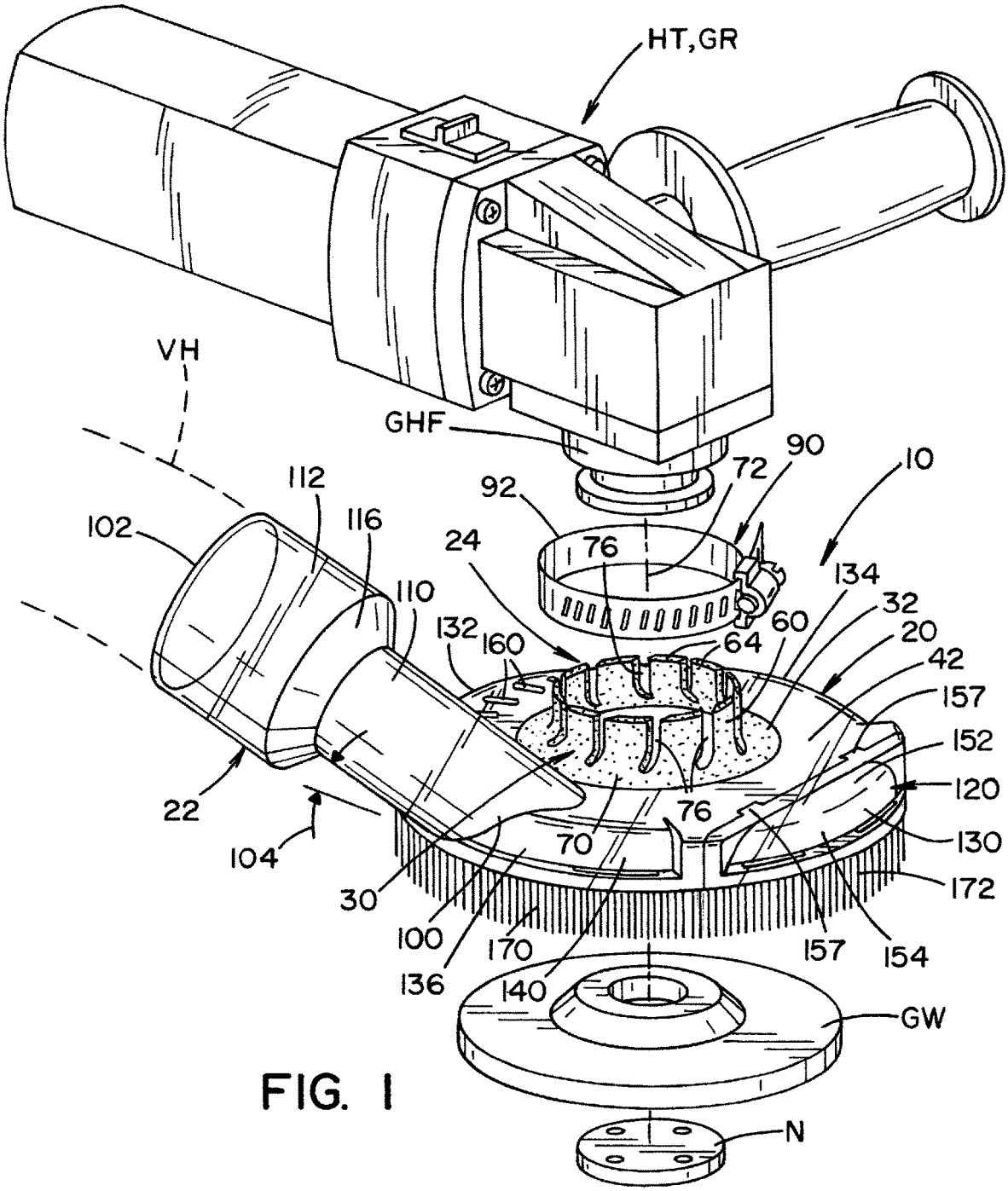
FIG. 1 is an exploded front side perspective view of a dust shroud according to certain aspects of the present invention and a hand held grinder.
Figure 2:
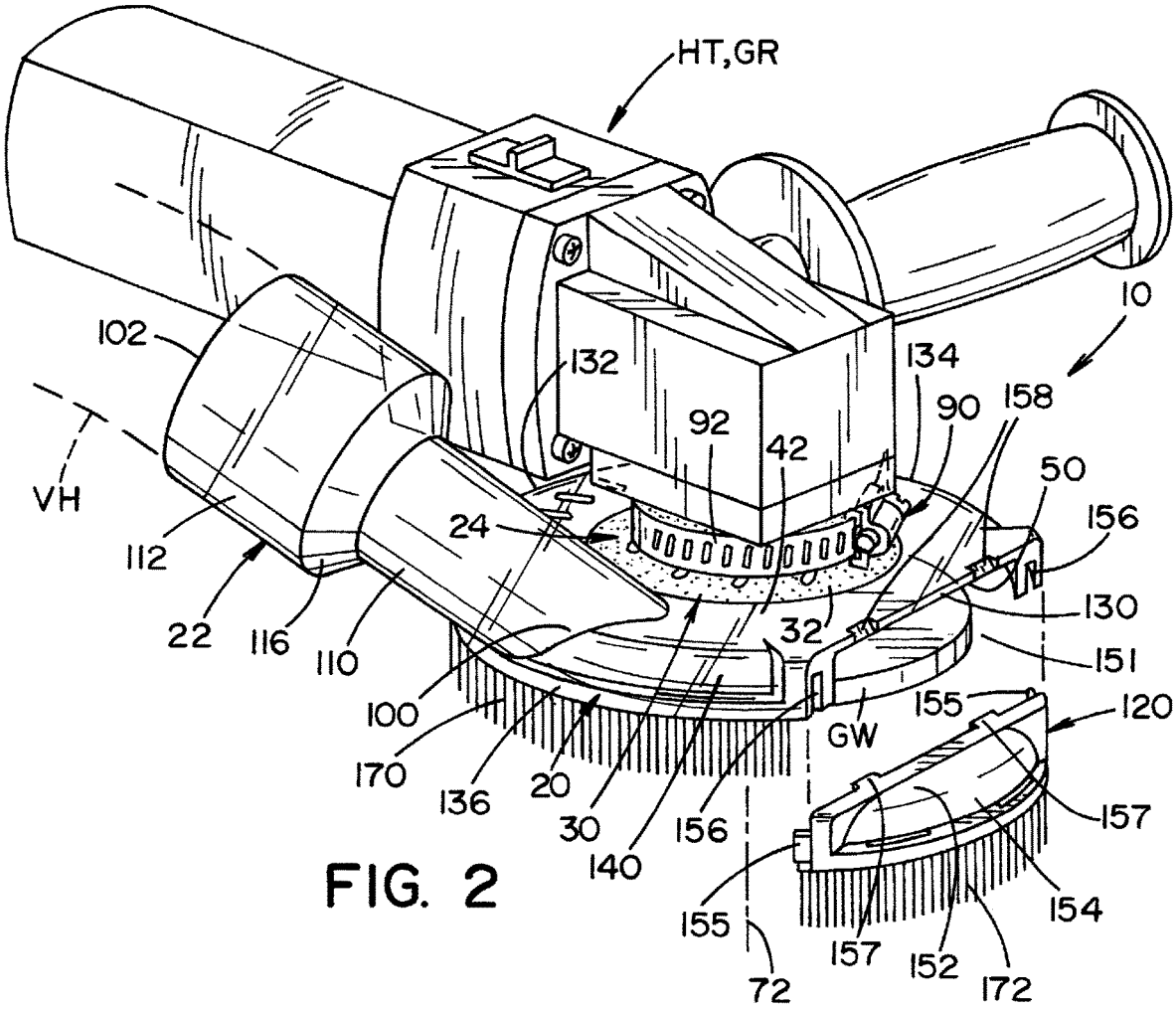
FIG. 2 is a front side perspective view of the dust shroud shown in FIG. 1 connected to the hand held grinder and with a wall section removed.
Figure 3:
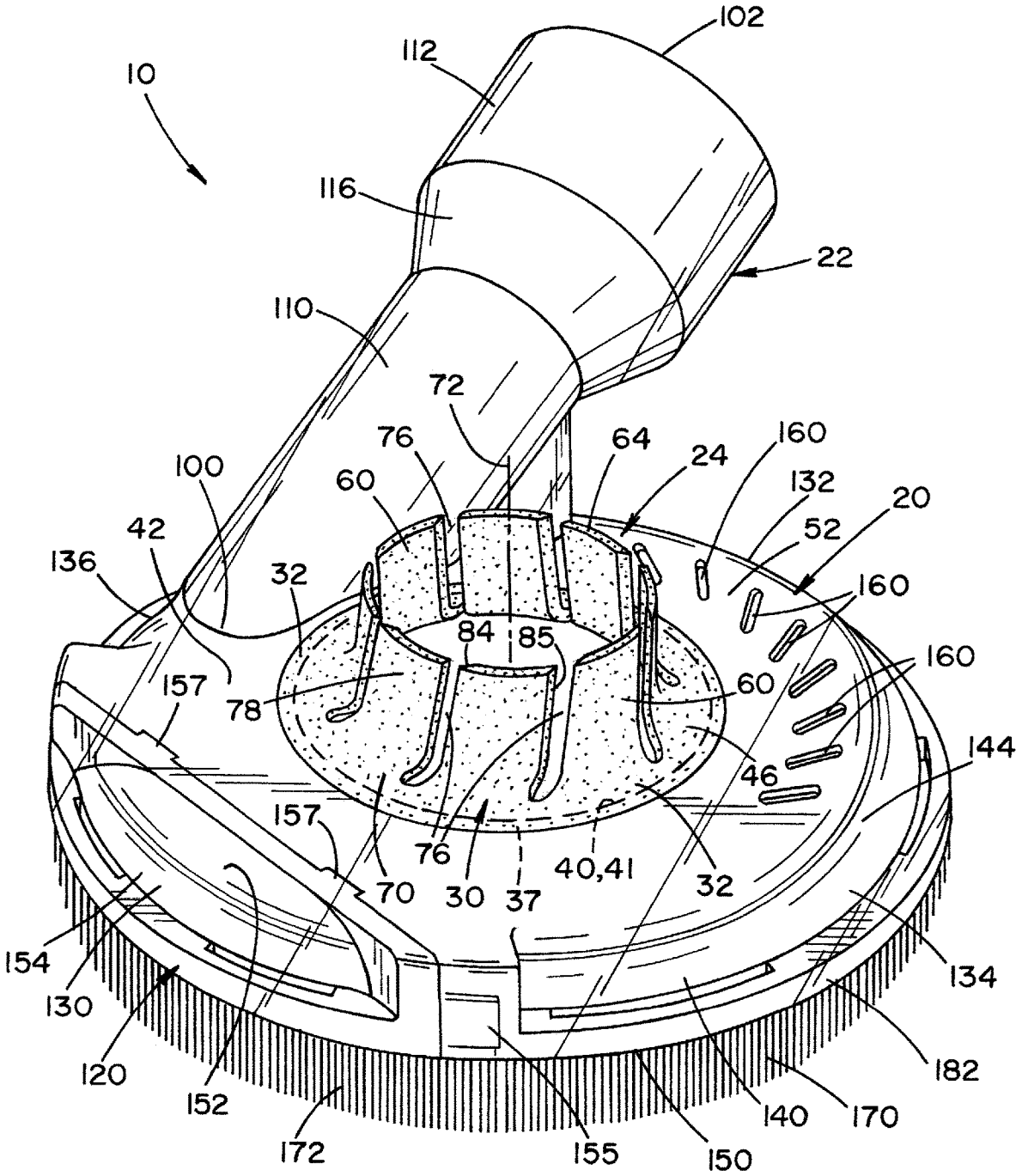
FIG. 3 is a perspective view of the dust shroud shown in FIG. 1.
Figure 4:
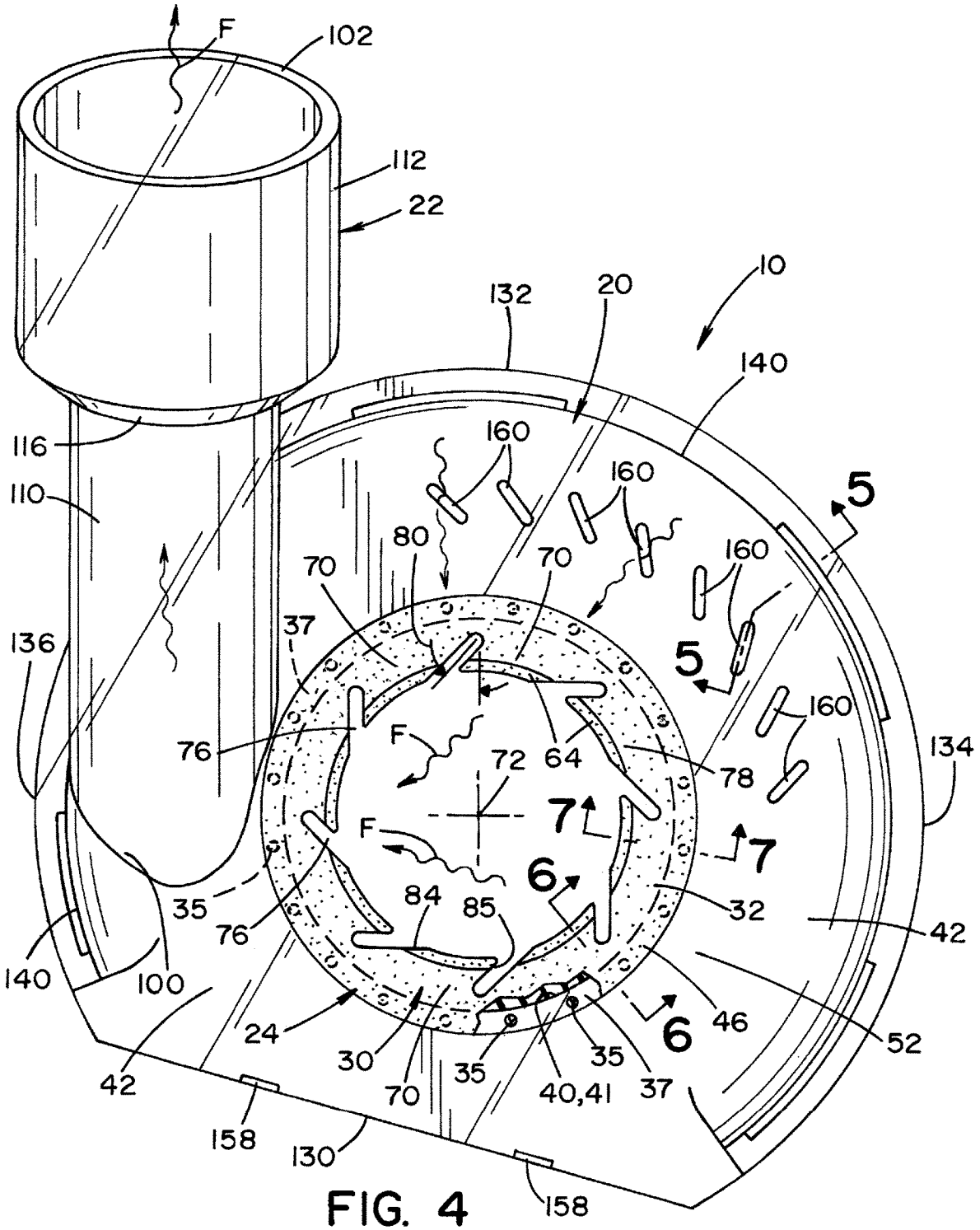
FIG. 4 is a top view of the present invention shown in FIG. 1 with the wall section removed.

Referring now to the drawings wherein the showings are for the purpose of illustrating preferred and alternative embodiments of the invention only and not for the purpose of limiting the same, FIGS. 1-9 show several embodiments of a dust shroud 10. Moreover, the dust shroud of this invention can have a wide range of sizes wherein the invention of this application is not to be limited to a specific size and/or not to be limited to a specific size hand held tool or grinder.

In greater detail, the dust shroud 10 includes a shroud body 20 having a vacuum port or connection 22 and a tool connection 24 wherein the vacuum port is selectively connectable to a vacuum hose VH and the tool connection is selectively connectable to a hand held tool HT, such as a hand held grinder GR. As will be discussed more below, tool connection 24 is configured to allow dust shroud 10 to be used with a wide range of grinders GR.

More particularly, tool connection 24 includes an adaptive overmolded rubber flexible fitting 30 to allow for this use on a wide range of grinders. Flexible fitting 30 includes a base 32 that is configured to be fixed relative to a top opening 40 in a top wall 42 of shroud body 20. Base 32 can include a base grove 34 that can allow fitting 30 to interengage with top opening 40, which can be formed by the overmolding process that will be discussed more below. In greater detail, top opening 40 is defined by a perimeter edge 41 and the edge can include a flange portion 37 extending about top opening 40. Edge 41 and thus top opening 40 can be circular and can be generally centered in top wall 42. Flange portion 37 can be a central flange, as is shown, that is formed by a top recess 38 and a bottom recess 39 wherein the recess and flange arrangement can be utilized to improve the overmolded joint. As is shown, recesses 38 and 39 can be flat recesses, but this is not required. Flange 37 can further include one or more flange openings 35 circumferentially spaced about the flange. By including a flange recesses 38 and 39, the overmolded connection between fitting 30 and top wall 42 can be flush. In this respect, fitting 30 includes an inner surface 44 and an outer surface 46 and top wall 42 includes an inner surface 50 and an outer surface 52 wherein fitting inner surface 44 can be flush, or generally flush, with top wall inner surface 50 and fitting outer surface 46 can be flush, or generally flush, with top wall outer surface 52. By including the overmolded connection between fitting 30 and top wall 42, along with flange openings 35, the joint between these two components can be both robust and unobtrusive.

Flexible fitting 30 further includes a plurality of outwardly extending flexible fingers 60 that extend from a finger base 62 attached to base 32 to distal finger ends 64. Flexible fingers 60 have a finger length 66 between outer surface 52 and distal finger ends 64, which allow flexible fingers 60 to have multiple function. This include, but is not limited to, allowing dust shroud 10 to be mounted relative to a wide range of hand tools HT, allowing the end user to fine tune the connection between the hand tool and the dust shroud, allowing relative movement between the dust shroud and the hand tool and allowing the dust shroud to automatically return to the set position wherein the user can easily direct the grinding wheel within the dust shroud during operation. In one set of embodiments, finger length 66 is greater than 0.5 inches. In another set of embodiments, finger length 66 is greater than 0.75 inches. In a further embodiment finger length 66 is between 0.75 inches and 2 inches. In yet another set of embodiments, finger length 66 is between 0.75 inches and 1.75 inches. Each of fingers 60 can include a base finger portion 70 that extends inwardly toward a top opening axis 72 and an outer finger portion 73 that extends away from top wall 42 and base finger portion to distal finger end 64 wherein outer finger portions 73 can be generally parallel to axis 72. One or more of fingers 60 can include a distal end flange 74, which can extend away from opening axis 72. Further, each finger 60 can be spaced from one another by a finger spacing 76. As will be discussed more below, finger spacing 76 can allow connection 24 to work on an even wider range of hand tools HT. Moreover, finger spacings 76 can allow increased flexible motion of the dust shroud relative to the hand tools to allow a greater range of motion of the grinding wheel or implement GW relative to the dust shield. As is known, a fastener or nut N can be used to join the grinding wheel or implement to tool HT after dust shield 10 is secured relative to the hand tool. In one set of embodiments, finger spacings 76 is greater than 0.050 inches. In another set of embodiments, finger spacings 76 is greater than 0.075 inches. In a further embodiment finger length 66 is greater than 0.100. In yet another set of embodiments, finger spacings 76 is between 0.075 inches and 0.200 inches.

In order to further increase the range of relative motion between the dust shield and the grinding wheel, finger spacings 76 can also include an angled configuration. In this respect, fingers flexible fingers 60 can include an angled portion 78. In the embodiment shown, base finger portion 70 can include the angled portion wherein a longitudinal axis of each finger spacing extends at a finger spacing angle 80 from the flexible fitting base inwardly such that an extension of the longitudinal axis does not intersect top opening center axis 72 and the finger spacing angle is defined between the longitudinal axis of the finger spacing and a radial line from top opening axis 72 to an inner end of the finger spacing near the flexible fitting base. In one set of embodiments, finger angle 80 is less than 90 degrees. In another set of embodiments, finger angle 80 is greater than 45 degrees. As a result, finger spacings 76 can be angled wherein the spacings and the fingers extend at finger angle 80. And, this can be used to further increase the range of opening sizes for connecting portion 24 and the range of motion of the grinder relative to the dust shroud. Yet even further, fingers 60 can further include a center portion 82 that connects and/or transitions base finger portion 70 into outer finger portion 73 that can be at a different angle and/or be curved. Again, this can be used to increase the range of opening sizes for connecting portion 24. Again, and as will be discussed more below, these features can also increase the flexing range of connecting portion 24 to further improve the relative movement of the dust shroud relative to the grinding wheel or implement.

Figure 9:
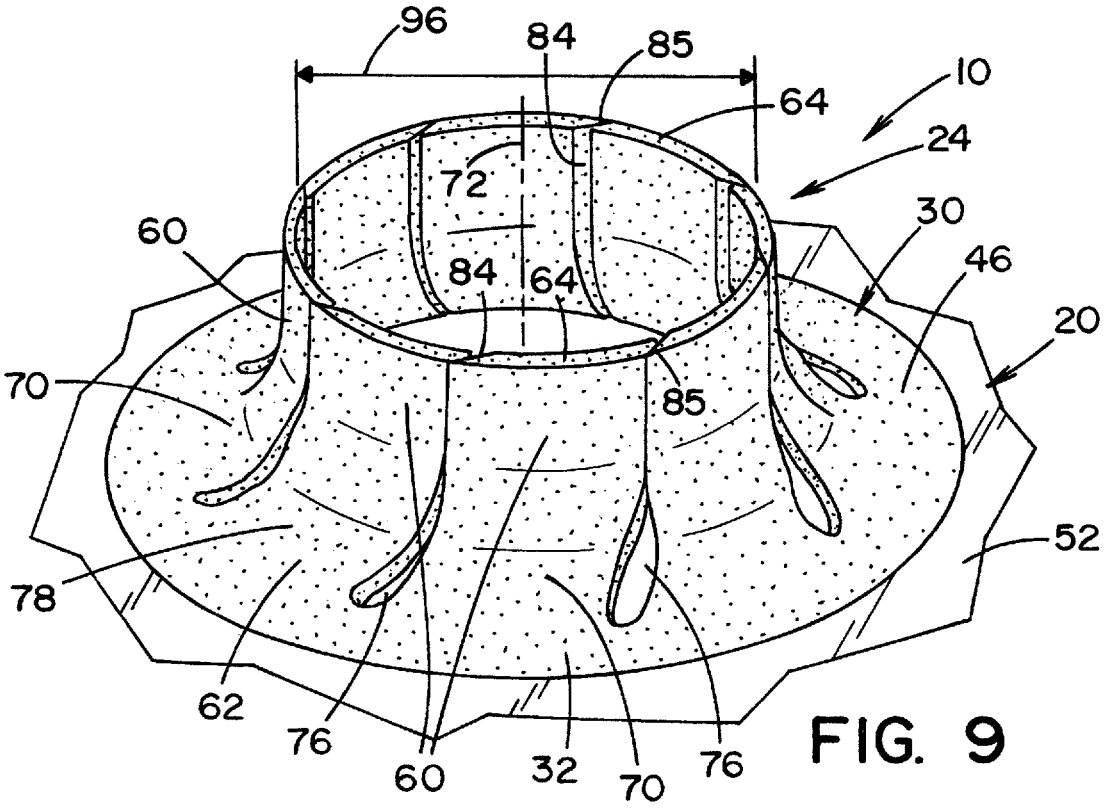

To further increase the range of the connecting portion, the edges of the finger can have a shaped and/or mating configuration. In this respect, each finger includes a first side edge 84 and an opposite second side 85. Some or all of the side edges can have a mating configuration. As is best shown in FIG. 9, the side edges includes a chiseled edge portion to allow mating engagement when they are clamped together to further increase the range of motion and adjustability of dust shield.

Figure 8:
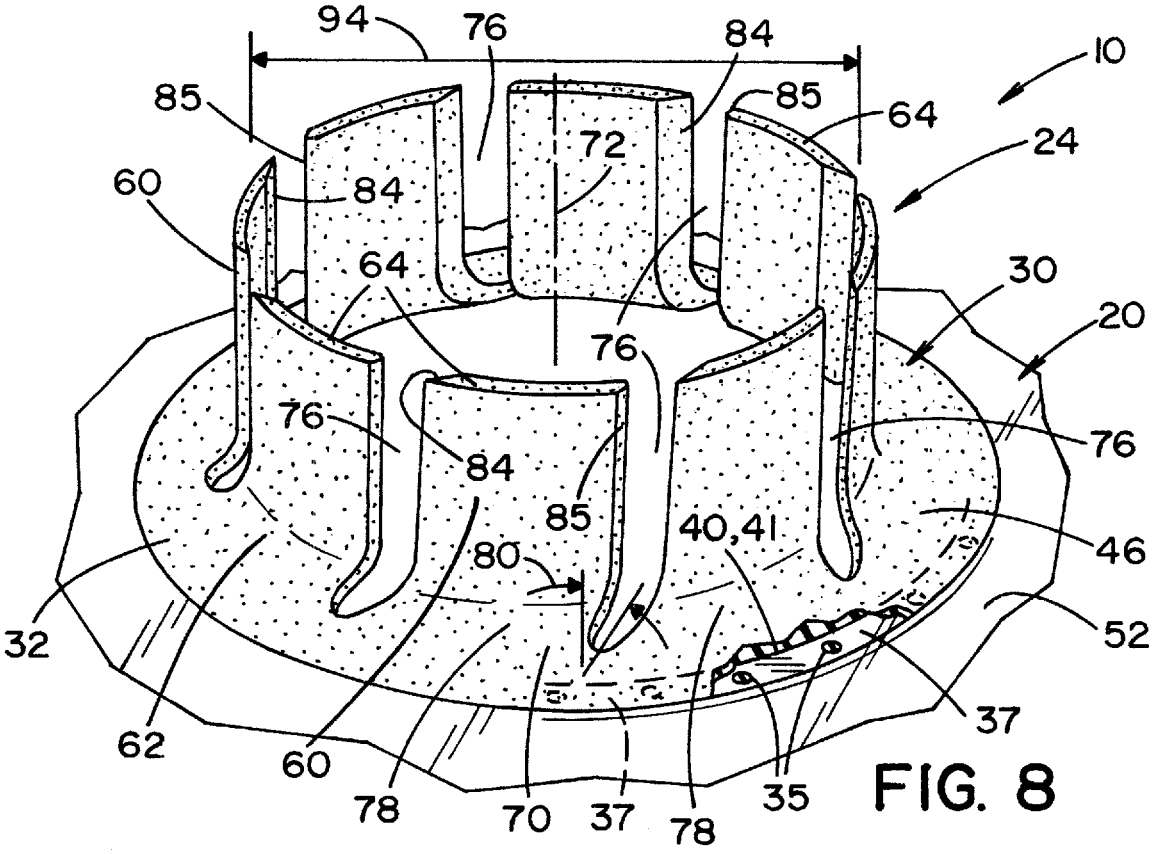
FIG. 8 is an enlarged perspective view of a tool connection portion of the dust shroud shown in FIG. 1 according to certain aspects of the invention and shown in a relaxed condition; and, FIG. 9 is an enlarged perspective view of the tool connection shown in FIG. 8 shown in a fully compressed condition.

Tool connection 24 further includes a clamp arrangement 90 that can be configure to allow flexible fitting 30 to be quickly fixed relative to the wide range of grinders GR. In greater detail, clamp arrangement 90 can include a hose clamp or worm clamp 92 to provide an inward clamping force toward axis 72 to secure the flexible fitting relative to a portion of the grinder. This configuration has been found to allow shroud 10 to be used with a wide range of grinders GR and to be securely fixed relative to these grinders for use by the end user. In this respect, fingers 60 are flexible wherein they can bend such that they can fit over a wide range of grinder head flanges GHF (mount point). In this respect, flexible fingers 60 of flexible fitting 30 have a relaxed or un-flexed configuration or diameter 94 as is best shown in FIG. 8. However, flexible fingers 60 of flexible fitting 30 can flex both outwardly and inwardly from the un-flexed condition shown in FIG. 8 to allow use in connection with a wide range of tools. With reference to FIG. 9, which shows flexible fingers 60 of flexible fitting 30 in a fully compressed condition or diameter 96 wherein flexible fingers 60 of flexible fitting 30 according to the invention of this application have a wide range of motion and; therefore, can be used with a wide range of tools. According to one set of embodiments, fully compressed condition 96 can be down to a 1.5" diameter. Clamp arrangement 90 can extend about outer finger portions 73 of fingers 60 and urge these finger portions into engagement with a portion of grinder GR, such as grinder head flanges GHF. Flange 74 can be configured to help maintain the engagement between clamp arrangement 90 and outer finger portions 73.

Yet even further, tool connection 24 of the invention of this application allows dust shroud 10 to flex relative to grinder GR to allow for a better seal between dust shroud 10 and the work piece. In this respect, flexible fingers 60 not only allow tool connection 24 to be connected to a wide range of grinders, but also allow controlled relative movement between the grinder and the dust shroud with an automatic return to the natural position, as is shown in the figures. This allows for controlled movement between the shroud and uneven grinding surfaces and for changes in the tool angle between the grinder and the work piece. Thus, the rubber overmolded configuration of connecting portion 24 allows the shroud to be attached to most angle grinders quickly and easily without changing out clamps designed for each angle grinder type. Moreover, the rubber overmolded configuration of connecting portion 24 allows for flexibility while in use and allows the user to control height of the shroud to accommodate different types of grinding wheels, different spacing between the grinder and the opening in the dust shroud and different angles between the grinder and the dust shroud.

Vacuum port 22 can also be configured to work in connection with a wide range of vacuum hoses. In this respect, vacuum port 22 includes a port base 100 that is in fluid connection with shroud body 20. In the embodiment shown, port base 100 can be connected to top wall 42 and can be adjacent to top wall opening 40. Vacuum port 22 extends from port base 100 to a port distal end 102 and can extend away from body 20 at a port angle 104. In one set of embodiments port angle 104 is between 20 degrees and 60 degrees. In another set of embodiments port angle 104 is between 20 degrees and 45 degrees. In the embodiment shown, vacuum port 22 can also extend rearwardly away from body 20. Further, vacuum port 22 can include a first port section 110 near port base 100 and a second port section 112 near port distal end 102. In one set of embodiments, first port section 110 can be shaped to receive a first size vacuum hose size and second port section 112 can be shaped to receive a second size vacuum hose size so that dust shroud 10 can also be used in connection with a wide range of vacuum hoses. In the embodiments shown, first port section 110 is smaller than second port section 112. Moreover, vacuum port 22 further include a transition port section 116 between first port section 110 and second port section 112 to connect these sections and/or create smoother air flow between these sections.

Shroud body 20 of dust shroud 10 can further include one or more removable wall sections 120, which can be used to allow better access to the grinding wheel of grinder. In greater detail, shroud body 20 can include a front side 130, a rear side 132, a first side 134 and a second side 136 wherein the sides can extend between the front and rear of the body. Further, shroud body can include one or more side walls 140 that can extend from top wall 42 and can at least partially define a dust receiving opening 142 that can be opposite of top wall 42. Wall 140 and/or top wall 42 can include an arcuate or transition region 144 therebetween. In the embodiments shown, shroud body 20 can be a generally round body having a generally round top wall 42 and a generally round dust receiving opening 142 opposite of the top wall, but this is not required. And, according to one set of embodiments, tool connection 24 can be generally centered in top wall 42. Yet further, shroud body 20 can be dish shaped wherein one or more downwardly extending side walls 140 can be a single side wall excluding any wall portion formed in the one or more removable wall sections. One or more downwardly extending side walls 140 can extend from top wall 42 and extend to a side wall extent or bottom edge 150 that can at least partially define dust receiving opening 142 opposite the top wall 42.

According to the embodiments shown, removable wall section 120 can be a removable side wall section to create a side opening 151. Yet further, removable side wall section can include a removable section top 152 generally in line with a section of top wall 42 and a removable section side wall 154 generally in line with side wall 140. In the embodiment shown, removable section 120 can be a removable front side section. Removable side wall section 120 can include any fastening system to selectively secure the removable section to body 20 without detracting from the invention of this application. This can include, but is not limited to, locking tabs, fasteners, hinges, bands, clips, resistance hinges, clasps, mating locking arrangements, and the like. In the embodiments shown, removable wall section 120 includes tabs 155 and shroud body 20 includes channels 156 that are shaped to received tabs 155 for vertical sliding motion between wall section 120 and shroud body 20, with reference to the orientation in the drawings. Further, wall section 120 can include one or more locking tabs 157 and shroud body can include one or more locking detents 158 shaped to receive the locking tabs and selectively secure the removable wall section relative to shroud body. Yet further, the wall section can be a flexible wall section wherein the section remains connected but which flexes out of the way when pressure is applied by tool operator, but will return to a closed condition when the pressure is removed.

Shroud body 20 can further include one or more air vent or intake holes or ports 160 to produce a desired airflow F within an inner space 162 of dust shroud 10. As is shown, body 20 includes a plurality of elongated air holes or vents 160, but the number shown is not required. Also shown in the described embodiments, the vents are positioned to produce desired airflow F that has been found to increase the efficiency of the dust shroud system to maximize the dust removal abilities of the dust shroud of this application. In greater detail, vacuum port 22 extends from second side 136 and air vent 160 can be positioned in first side 134 and/or near rear side 132 to produce airflow F within the inner space that flows past tool connection 24 of shroud 10. Yet even further, vents 160 can include vents 160 in a vent pattern that extend toward rear side 132 and/or include vents in rear side 132. This can be used to produce the desired airflow, which factors in the rotation of the grinding wheel. Yet further, the vent pattern can be an arcuate vent pattern of vents 160 that can follow the general location of the side edge of the grinding wheel to further improve airflow and dust removal.

Figure 5:
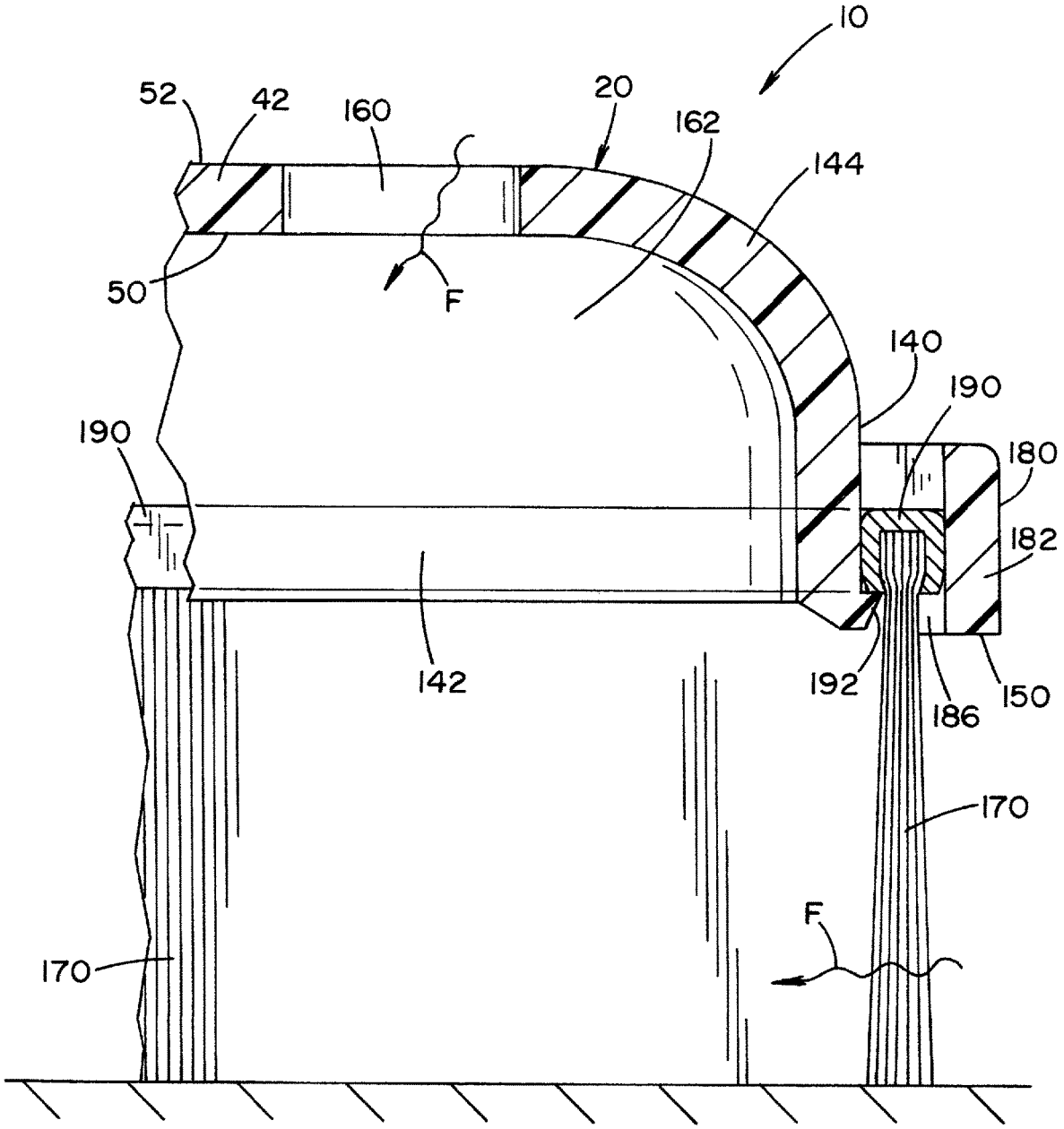
FIG. 5 is a sectional view taken along line 5-5 in FIG. 4.
Figure 6:
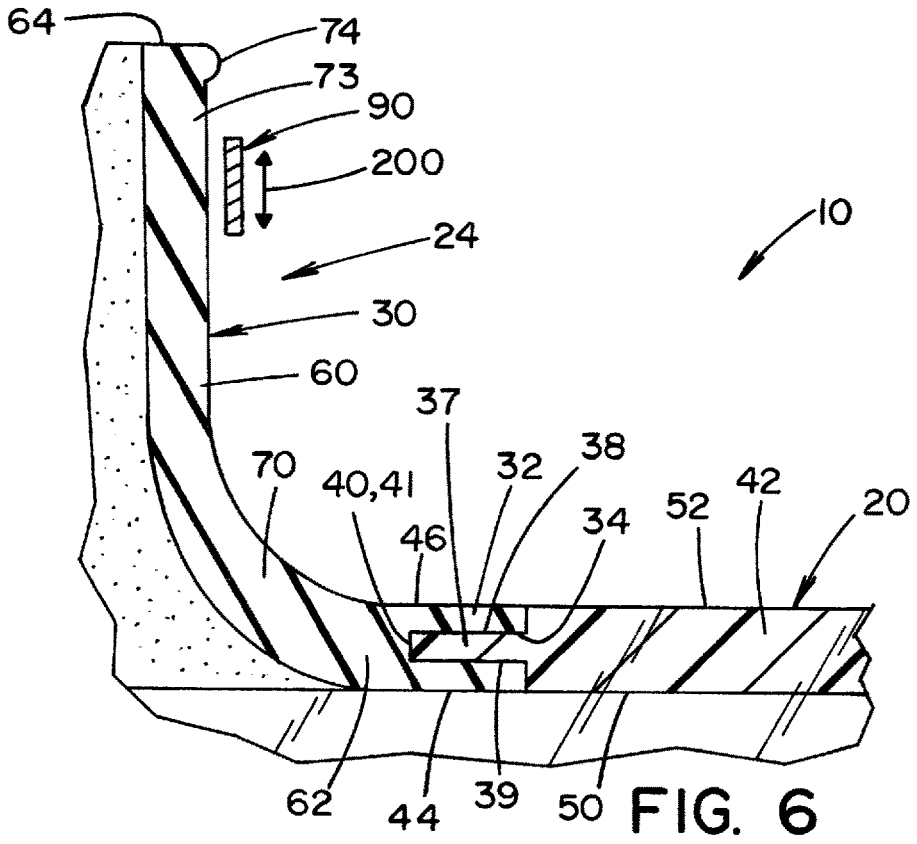
FIG. 6 is a sectional view taken along line 6-6 in FIG. 4.
Figure 7:
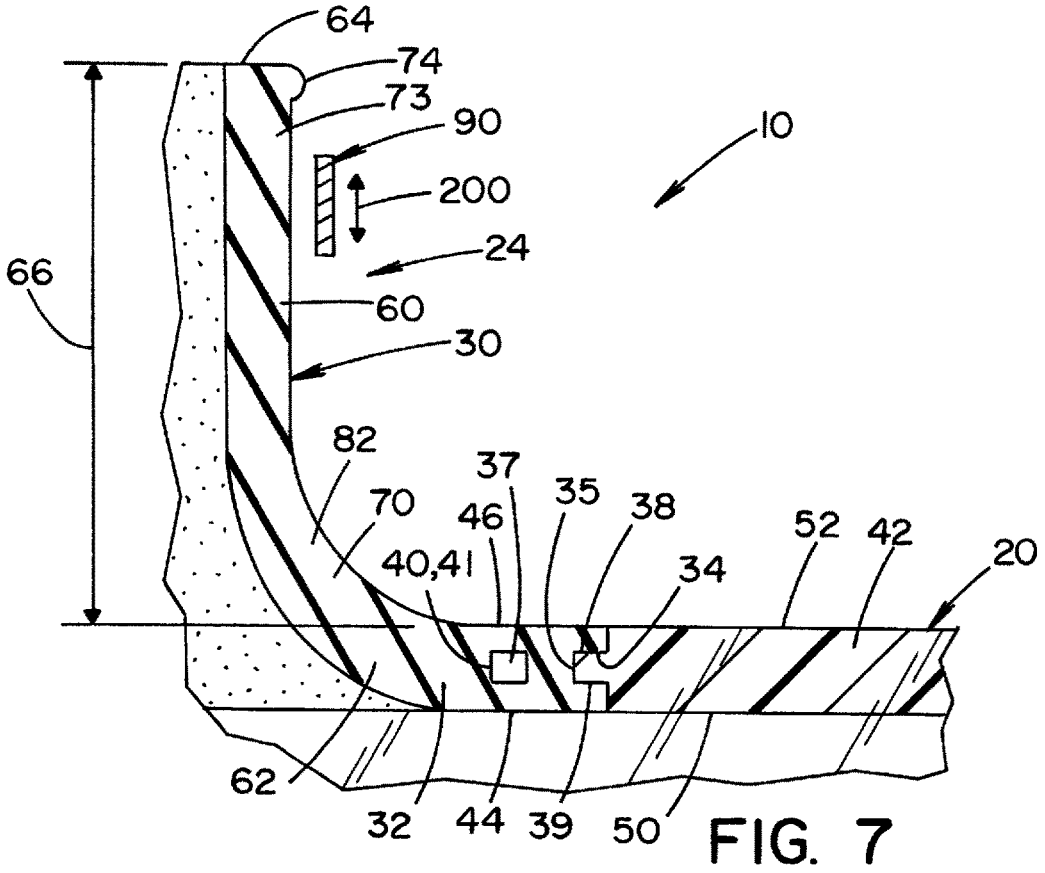
FIG. 7 is a sectional view taken along line 7-7 in FIG. 4.

Dust shroud 10 can further include shroud body 20 that includes one or more flexible extensions 170 that extend downwardly or away from bottom edge(s) 150 of the one or more side walls to help seal the bottom edge relative to the work piece thereby improving the desired airflow within the inner space. Yet further, one or more removable wall sections 120 can include flexible extension 172. According to once set of embodiments, flexible extensions 170 and/or 172 can include one or more brush extensions. Even yet further, side walls can be formed by flexible extensions and/or the side walls can be flexible wherein the side walls can form the flexible extensions. In order to retain the flexible extensions relative to body 20, body 20 can include a downwardly facing, relative to the drawings, locking channel 180, which is best shown in FIG. 5. Locking channel 180 can include an outer wall section 182 defining an inner channel opening 186 shaped to receive a brush clip 190. Locking channel 180 can further include a clip tab 192 to lock brush clip 190, and thus flexible extension 170, relative to the locking channel.

In operation, dust shroud 10 is fixed relative to hand tool HT by first removing grinding wheel GW. Once the grinding wheel is removed, shroud body 20 can be flexibly fixed relative to hand tool HT by way of tool connection 24. This is done by first positioning clamp arrangement 90 about tool connection 24 and then positioning tool connection 24 over grinder head flange GHF of hand tool HT. Clamp arrangement 90 and grinder head flange GHF can be moved relative to fingers 60, as is shown by arrow 200, to allow the user to control height of the shroud to accommodate different types of grinding wheels, desired spacing between the grinder and the shroud opening or any other desired custom fit between the grinder and the dust shroud. Once tool connection 24 is in the desired position over grinder head flange GHF, clamp arrangement 90 can be tightened about the grinder head flange to flexibly secure the dust shield relative to the hand tool. In addition, vacuum hose VH can be positioned in vacuum port 22. A vacuum (not shown), can then be turned on to remove dust that is created by the grinder during grinding. Once the vacuum is on, the tool is used to grind a surface to be ground. In that tool connection 24 is flexible, the user can simply apply pressure to the hand tool and the grinding wheel will be easily urged toward opening 150 to allow engagement between the grinding wheel and the surface to be ground. Once the pressure is removed, the grinding wheel will automatically move back inwardly within the dust shroud. If the user needs to use the edge of the grinding wheel, removable wall section 120 can be removed to open side opening. Again, pressure can be applied to the hand tool to urge the grinding wheel toward opening 150 to allow engagement between the grinding wheel and the surface to be ground.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

It is claimed:

1. A dust shroud for a hand held grinder, the dust shroud comprising a shroud body that includes a vacuum port or connection and a tool connection, the vacuum port being selectively connectable to an associated vacuum hose and the tool connection being selectively connectable to an associated mounting point on an associated hand held tool, the shroud body including a top wall and at least one side wall extending downwardly from about a perimeter of the top wall, the at least one side wall at least partially defining a dust receiving opening opposite of the top wall, the shroud body further including a top wall opening in the top wall, the tool connection including a flexible fitting having a flexible fitting base joined relative to the top wall of the shroud body and extending within the top wall opening, the flexible fitting further including a plurality of outwardly extending flexible fingers wherein each of the plurality of outwardly extending flexible fingers extends from a finger base end joined relative to the flexible fitting base and to a distal finger end, said each of the plurality of outwardly extending flexible fingers having a base finger portion that extends inwardly toward a top opening center axis of the top opening and an outer finger portion that extends away from top wall, the outer finger portion being configured to selectively engage the associated mounting point of the associated hand held tool to selectively secure the dust shroud relative to the associated hand held tool, the plurality of outwardly extending flexible fingers allowing selective controlled relative movement between the dust shroud and the associated hand held tool, said each of the plurality of outwardly extending flexible fingers having a finger spacing between an adjacent flexible finger, said each of the plurality of outwardly extending flexible fingers having a finger length between the top wall and the distal finger end, the finger length allowing the associated mounting point of the associated hand held tool to be selectively adjustable along the outer finger portion thereby allowing adjustment of a connection between the associated hand held tool and the dust shroud and allowing relative movement between the dust shroud and the associated hand held tool, wherein a longitudinal axis of each finger spacing extends at a finger spacing angle from the flexible fitting base inwardly such that an extension of the longitudinal axis does not intersect the top opening center axis, and the finger spacing angle is defined between the longitudinal axis of the finger spacing and a radial line from the top opening center axis to an inner end of the finger spacing near the flexible fitting base, such that the base finger portion of said each of the plurality of outwardly extending flexible fingers extend inwardly from the top wall and the finger angle spacing is less than 90 degrees.

2. The dust shroud of claim 1, wherein the finger length is greater than 0.75 inches and less than 2 inches.

3. The dust shroud of claim 2, wherein the finger length is between 0.85 inches and 1.75 inches.

4. The dust shroud of claim 1, wherein the outer finger portion is generally parallel to the top opening axis.

5. The dust shroud of claim 1, wherein the outer finger portion includes a distal end flange.

6. The dust shroud of claim 1, wherein the finger spacing angle that is greater than 45 degrees.

7. The dust shroud of claim 1, wherein the finger spacing between the adjacent flexible finger extends all the way to the flexible fitting base.

8. The dust shroud of claim 1, wherein said each of the plurality of outwardly extending flexible finger includes a first side edge and an opposite second side edge, at least a portion of the first and second side edges including a mating chiseled edge portion.

9. The dust shroud of claim 1, wherein the tool connection further includes a clamp arrangement.

10. The dust shroud of claim 9, wherein the clamp arrangement includes at least one of a hose clamp and a worm clamp.

11. The dust shroud of claim 1, wherein the top wall opening is defined by a perimeter edge and the flexible fitting being overmolded over the perimeter edge forming an overmolded section.

12. The dust shroud of claim 11, wherein the perimeter edge includes an edge flange formed from a top recess and a bottom recess wherein the overmolded section is generally flush with a top and a bottom surface of the top wall.

13. The dust shroud of claim 12, wherein the edge flange includes a plurality of flange openings circumferentially spaced about the top opening center axis to strengthen a connection fit between the flexible fitting and the top wall.

14. The dust shroud of claim 12, wherein the flexible fitting includes an inner flexible fitting surface and an outer flexible fitting surface, the outer flexible fitting surface being generally flush with the top surface of the top wall and the inner flexible fitting surface being generally flush with the bottom surface of the top wall.

15. The dust shroud of claim 1, wherein the vacuum port includes a first port section and a second port section wherein the first port section is shaped to receive a first sized associated vacuum hose and the second port section is shaped to receive a second sized associated vacuum hose.

16. The dust shroud of claim 1, wherein the shroud body includes a front side, a rear side, a first side and a second side, the vacuum port extending rearwardly from the first side, the top wall further including a plurality of air intake holes on at least one of the second side and the rear side.

17. The dust shroud of claim 16, wherein the shroud body includes downwardly extending flexible extensions about the dust receiving opening.

18. The dust shroud of claim 17, wherein the finger length is between 0.75 inches and 1.75 inches and the outer finger portion is generally parallel to the top opening center axis, said each of the plurality of outwardly extending flexible finger includes a first side edge and an opposite second side edge, at least a portion of the first and second side edges including a mating chiseled edge portion, the tool connection further includes a clamp arrangement including at least one of a hose clamp and a worm clamp, the top wall opening being defined by a perimeter edge wherein the perimeter edge includes an edge flange formed from a top recess and a bottom recess, the flexible fitting being overmolded over the edge flange such that an overmolded section is generally flush with a top and a bottom surface of the top wall, the edge flange including a plurality of flange openings circumferentially spaced about the top opening center axis to strengthen a connection fit between the flexible fitting and the top wall, the vacuum port includes a first port section and a second port section wherein the first port section is shaped to receive a first sized associated vacuum hose and the second port section is shaped to receive a second sized associated vacuum hose, the plurality of air intake holes extending from the second side toward the rear side wherein the air flow passes the top opening.

19. The dust shroud of claim 18, wherein the shroud body includes at least one selectively removable wall sections.

20. The dust shroud of claim 1, wherein the finger length is greater than 0.75 inches.

* * * * *